United States Patent [19]
Baldwin et al.
[11] 4,244,812
[45] Jan. 13, 1981

[54] SYSTEM FOR PRODUCING A POWDERY COMPOSITION COMPRISING COAL PRODUCTS IN A COAL DEASHING PROCESS

[75] Inventors: Roger A. Baldwin, Warr Acres; Robert E. Davis; Robert E. Leonard, both of Oklahoma City, Okla.

[73] Assignee: Kerr-McGee Corporation, Oklahoma City, Okla.

[21] Appl. No.: 973,876

[22] Filed: Dec. 28, 1978

Related U.S. Application Data

[63] Continuation-in-part of Ser. No. 691,573, Jun. 1, 1976, abandoned.

[51] Int. Cl.[3] ..... C10G 21/12; C10L 5/00
[52] U.S. Cl. ..... 208/177; 44/1 B; 44/1 C; 208/8 LE
[58] Field of Search ..... 208/177, 8 LE; 44/1 B, 44/1 C

[56] References Cited

U.S. PATENT DOCUMENTS

| | | | |
|---|---|---|---|
| 3,607,716 | 9/1971 | Roach | 208/8 LE |
| 3,884,794 | 5/1975 | Bull et al. | 208/8 LE |
| 4,070,268 | 1/1978 | Davis et al. | 208/8 LE |
| 4,090,958 | 5/1978 | Leonard | 208/8 LE |
| 4,119,524 | 10/1978 | Leonard et al. | 208/8 LE |

*Primary Examiner*—Herbert Levine
*Attorney, Agent, or Firm*—William G. Addison

[57] ABSTRACT

An improved system for deashing coal liquefaction products wherein a feed mixture (including a deashing solvent, soluble coal products and insoluble coal products) is separated in a first separation zone into a first light fraction and a first heavy fraction (including insoluble coal products and some deashing solvent). The first heavy fraction is withdrawn from the first separation zone and the pressure level of the first heavy fraction is reduced at least 100 psig for vaporizing the deashing solvent and for yielding a composition substantially comprising coal products. The composition is essentially a powdery, solid material and is capable of being transferred via a slurry or mechanical means.

20 Claims, 3 Drawing Figures

TRIANGULAR COMPOSITION DIAGRAM OF THE FIRST HEAVY FRACTION COMPOSITION

SYSTEM FOR PRODUCING A POWDERY COMPOSITION COMPRISING COAL PRODUCTS IN A COAL DEASHING PROCESS

CROSS REFERENCE TO RELATED APPLICATIONS

This application is a continuation-in-part of applicants copending application Ser. No. 691,573 entitled "A Powdery Composition Comprising Insoluble Coal Products And System For Producing Same In A Coal Deashing Process", filed June 1, 1976 now abandoned and applicants copending application Ser. No. 838,021 entitled "A Powdery Composition Comprising Coal Products And System For Producing Same In A Coal Deashing Process", filed Sept. 29, 1977, now abandoned, the entire disclosures of which are incorporated herein by reference.

BACKGROUND OF THE INVENTION

1. Field of the Invention

The present invention relates generally to coal deashing processes and, more particularly, but not by way of limitation, to systems for producing a powdery composition comprising coal products in coal deashing processes.

2. Description of the Prior Art

Various coal deashing processes have been developed in the past wherein coal has been treated with one or more solvents and processed to separate the resulting insoluble coal products from the soluble coal products.

U.S. Pat. Nos. 3,607,716 and 3,607,717, issued to Roach and assigned to the same assignee as the present invention, disclose processes wherein coal is contacted with a solvent and the resulting mixture then is separated into a heavy phase containing the insoluble coal products and a light phase containing the soluble coal products. In such processes, the light phase is withdrawn and passed to downstream fractionating vessels wherein the soluble coal product can be separated into multiple fractions. Other processes for separating the soluble coal products from the insoluble coal products utilizing one or more solvents are disclosed in U.S. Pat. Nos. 3,607,718, and 3,642,708, both issued to Roach et al, and assigned to the same assignee as the present invention.

DESCRIPTION OF THE PREFERRED EMBODIMENTS

Figure 1:
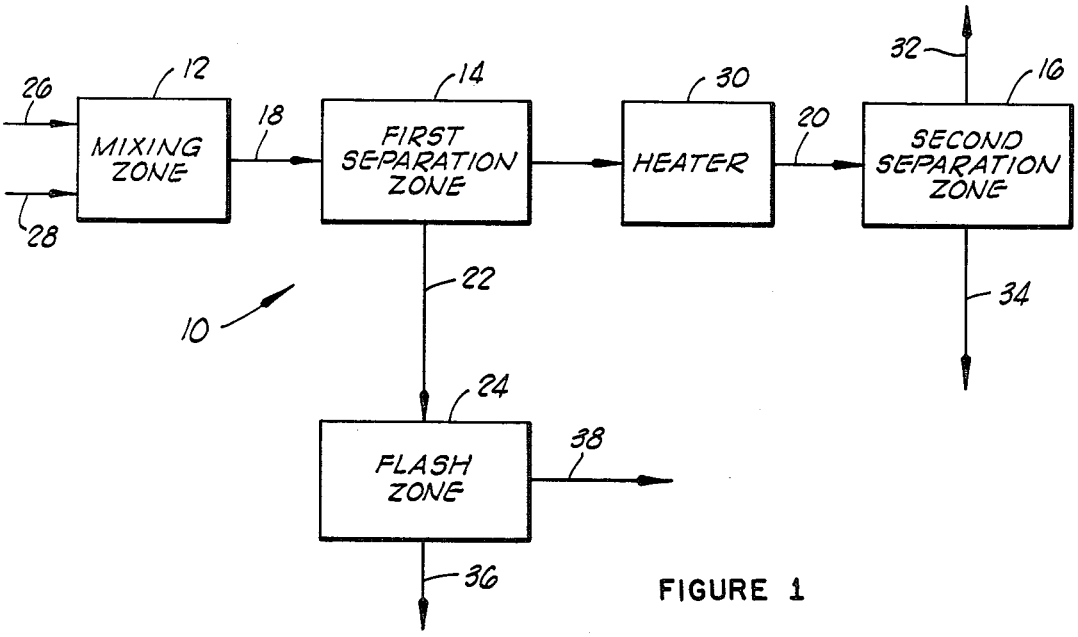
FIG. 1 is a schematic, diagrammatic view showing one system arranged in accordance with the present invention.

Referring now to FIG. 1, general reference numeral 10 designates a system for deashing coal liquefaction products arranged in accordance with the present invention, which includes a mixing zone 12, a first separation zone 14 and a second separation zone 16.

In general, a feed mixture (comprising soluble coal products, insoluble coal products and deashing solvent) is passed from the mixing zone 12 through a conduit 18 into the first separation zone 14 wherein the feed mixture is separated into a first heavy fraction and a first light fraction. The first light fraction is passed through a conduit 20 into the second separation zone 16 wherein it is separated into a second light fraction and a second heavy fraction.

In accordance with the present invention, the first heavy fraction is withdrawn from the first separation zone 14 and passed through a conduit 22 into a flash zone 24 where the pressure on the first heavy fraction is reduced by an amount sufficient to vaporize the deashing solvent from the first heavy fraction and to yield a composition substantially comprising coal products. The composition is powdery in form, and thus is capable of being transferred by mechanical means, in a slurry form or other convenient means.

In one particular process, pulverized raw coal is contacted with a liquefaction solvent and liquefied to produce a mixture comprising the liquefaction solvent, the soluble coal products and the insoluble coal products. In this process, substantially all of the liquefaction solvent is removed by flashing, or some similar means, from the soluble and the insoluble coal products to produce a prepared mixture (coal liquefaction products) and then the prepared mixture is contacted with a deashing solvent in the mixing zone 12. The resulting mixture (comprising the soluble coal products, the insoluble coal products and the deashing solvent) comprises the feed mixture passed through the conduit 18 into the first separation zone 14.

Although the particular process generally described above for producing the feed mixture contemplates the utilization of different liquefaction and deashing solvents, the present invention also contemplates systems wherein the coal is contacted by a single liquefaction-deashing solvent or systems wherein the coal is contacted by more than two liquefaction-deashing solvents. Therefore, the feed mixture passing through the conduit 18 and introduced into the first separation zone 14 is referred to therein as including a "deashing solvent", which may be the deashing solvent or the liquefaction solvent or a combination of the liquefaction and deashing solvents or some other solvent or solvents utilized for producing the feed mixture comprising the soluble coal products, the insoluble coal products and the deashing solvent.

In the particular process generally described above, the "liquefaction solvent" preferably is an organic solvent suitable for liquefying coal, and various solvents suitable for liquefying coal are disclosed in the U.S. Pat. Nos. 3,607,716; 3,607,717; 3,607,718 and 3,642,608, the disclosures of which are incorporated herein by reference. The "deashing solvent" is of the type sometimes described as a "light organic solvent" in the just-mentioned U.S. patents and consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain monoolefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs. Also, the details of particular processes for liquefying coal and subsequently separating the soluble coal products from the insoluble coal products are disclosed in the just-mentioned U.S. patents.

The term "insoluble coal products" as used herein refers to the undissolved coal, ash, other solid inorganic particulate matter and other such matter which is insoluble in the deashing solvent solution under the conditions of the instant process. The insoluble inorganic material in coal which is sometimes assumed to be about equal to the ash remaining after igniting the coal under controlled conditions is sometimes referred to in the art as "mineral matter." With respect to coal and related minerals, typical mineral matter components include kaolinite, calcite, gypsum and pyrite. In thermally treated or hydrogenated materials, pyrite usually has been changed to pyrrhotite. Mineral matter analyses are reported frequently as oxide contents, that is, $SiO_2$, $Al_2O_3$, CaO and the like.

The term "soluble coal products" as used herein refers to the constituents in the feed mixture which are soluble in the deashing solvent.

The term "ash-free coal" as used herein refers to the soluble coal products and the insoluble coal products less the ash remaining after igniting the coal or coal products under controlled conditions.

Referring to the coal deashing process 10 of the present invention as depicted in FIG. 1, the mixture consisting essentially of the soluble coal products, the insoluble coal products and any liquefaction solvent (referred to herein as the "prepared mixture"), is passed through a conduit 26 into the mixing zone 12 and the deashing solvent is passed into the mixing zone 12 via a conduit 28. The deashing solvent may be contained in a solvent surge vessel or the like (not shown) and, in this embodiment, the deashing solvent is withdrawn from such vessel and pumped through the conduit 28 into the mixing zone 12. The prepared mixture is contacted by and mixed with the deashing solvent and the resulting mixture is discharged from the mixing zone 12 into and through the conduit 18, the mixture discharged from the mixing zone 12 comprising and being referred to herein as the "feed mixture."

In the first separation zone 14, the feed mixture is separated into a first light fraction and first heavy fraction. The first light fraction comprises most of the soluble coal products and most of the deashing solvent. The first separation zone 14 is maintained at a temperature level below about 700 degrees F. and at a pressure level in the range of from about the critical pressure of the deashing solvent to about 1000 psig to effect the separation. Preferably the first separation zone 14 is maintained at a temperature level in the range of from about 400 degrees F. to below about 700° F. and at a pressure level in the range of from about 700 psig to about 1000 psig. Most preferably the first separation zone 14 is maintained at a temperature level in the range of from about 400 degrees F. to about 650 degrees F. and the pressure level is maintained in the range of from about 800 psig to about 950 psig. The first light fraction is withdrawn from the first separation zone 14 and passed through a heater 30 and the conduit 20 into the second separation zone 16. The heater 30 serves to heat the first light fraction passing therethrough to an elevated temperature level, for example, to a range from about 630 degrees F. to about 900 degrees F. The pressure level in the second separation zone 16 is in the range of from about the critical pressure of the deashing solvent to about 1000 psig and preferably in the range of from about 650 psig to about 1000 psig. In the second separation zone 16, the first light fraction separates into a second light fraction comprising most of the deashing solvent and a second heavy fraction comprising the substantially ash-free soluble coal products and some of the deashing solvent. The second light fraction is withdrawn from the second separation zone 16 and passed through a conduit 32 for re-use in the system, and the second heavy fraction is withdrawn from the second separation zone 16 and passed through a conduit 34 for solvent removal and recovery of a deashed coal product suitable for use in combustion processes.

The first heavy fraction is withdrawn from the first separation zone 14 through the conduit 22 and passed into the flash zone 24 wherein the pressure level on the first heavy fraction is reduced to a level in the range of from about 0 psig to about 50 psig, to flash the first heavy fraction and form one stream comprising the deashing solvent and one stream comprising the insoluble coal products. The insoluble coal products are withdrawn from the flash zone 24 through a conduit 36. The deashing solvent is withdrawn from the flash zone 24 and passed through a conduit 38 for reuse.

In this process, it is important that the first heavy fraction within the first separation zone 14 be maintained in a flowable condition so the first heavy fraction, which includes the insoluble coal products and some of the deashing solvent, can be withdrawn from the first separation zone 14 in a convenient and efficient manner and in a manner having a minimum of fouling or clogging problems. Further, it is desirable that the first heavy fraction be of a nature that it can be passed through a pressure reducing device (the flash zone 24), such as a restricted orifice, for example, with minimal erosion thereto. The present invention results in a first heavy fraction which is flowable from the first separation zone 14 and through the conduit 22 into the flash zone 24. Further, the first heavy fraction produced in accordance with the present invention is suitable for passing through a restricted orifice wherein the pressure level of the first heavy fraction is reduced by at least 100 psig with minimal erosion to such restricted orifice, the pressure differential generally being at least 500 psig. Also, it has been discovered that, when the first heavy fraction produced in accordance with the present invention is flashed via a restricted orifice or the like to vaporize the deashing solvent, the remaining coal product composition withdrawn from the flash zone 24 is in a relatively dry, powdery, solid material form and this composition is capable of being transferred via a slurry or mechanical means.

In accordance with the present invention, the first heavy fraction in the first separation zone 14 and in the conduit 22 comprises deashing solvent in a range from about 10 percent by weight to about 35 percent by weight.

A more complete understanding of the composition of the first heavy fraction in the first separation zone 14 can be obtained by reference to TABLE I wherein a characterization of the first heavy fraction, for various coal liquefaction products derived from different feed coals and various operating conditions of the first separation zone 14, in terms of the percentages of deashing solvent, ash and ash-free coal present in the first heavy fraction, by weight, is set forth:

TABLE I

| Characterization Of The First Heavy Fraction | | | | | | | |
|---|---|---|---|---|---|---|---|
| Sample[1] No. | Deashing Solvent | Ratio of Deashing Solvent to Prepared Mixture in the Mixing Zone 12 | Temperature Level (°F.) in the First Separation Zone 14 | Pressure Level (psig) in the First Separation Zone 14 | First Heavy Fraction % Deashing Solvent | % Ash | % Ash-free Coal |
| 1 | Benzene | 1.76 | 470 | 800 | 17.32 | 22.68 | 60.00 |
| 2 | Benzene | 1.78 | 445 | 800 | 20.52 | 23.09 | 56.39 |
| 3 | Benzene | 1.69 | 470 | 800 | 21.11 | 21.11 | 56.78 |
| 4 | Toluene | 1.76 | 505 | 800 | 23.15 | 22.24 | 54.61 |
| 5 | Toluene | 1.68 | 538 | 800 | 20.51 | 23.10 | 56.39 |
| 6 | Toluene | 1.79 | 565 | 800 | 20.73 | 22.79 | 56.48 |
| 7 | Xylenes[2] | 2.0 | 565 | 800 | 16.83 | 23.92 | 59.25 |
| 8 | Mixed Solvent[3] | 3.0 | 565 | 800 | 18.59 | 23.17 | 58.24 |
| 9 | Xylenes[2] | 2.4 | 595 | 800 | 21.19 | 33.69 | 45.12 |
| 10 | Toluene | 2.05 | 503 | 810 | 20.22 | 24.47 | 55.31 |
| 11 | Toluene | 2.56 | 532 | 700 | 10.20 | 30.40 | 55.80 |
| 12 | Toluene | 3.8 | 617 | 800 | 25.40 | 36.30 | 38.30 |

[1]Samples 1-8 coal liquefaction product feed derived from Pittsburgh #8 coal, Samples 9-11 derived from Kentucky #9 and #14 coal and Sample 12 derived from Illinois #6 coal by catalytic liquefaction process.
[2]75.5% meta and para xylenes, 18% ortho xylene, 1.7% ethylbenzene and 4.8% other higher boiling components (percentages being by weight).
[3]20.1% toluene, 54.0% xylenes (mixture of ortho, meta and para) and 25.9% ethylbenzene (percentages being by weight).

Figure 2:
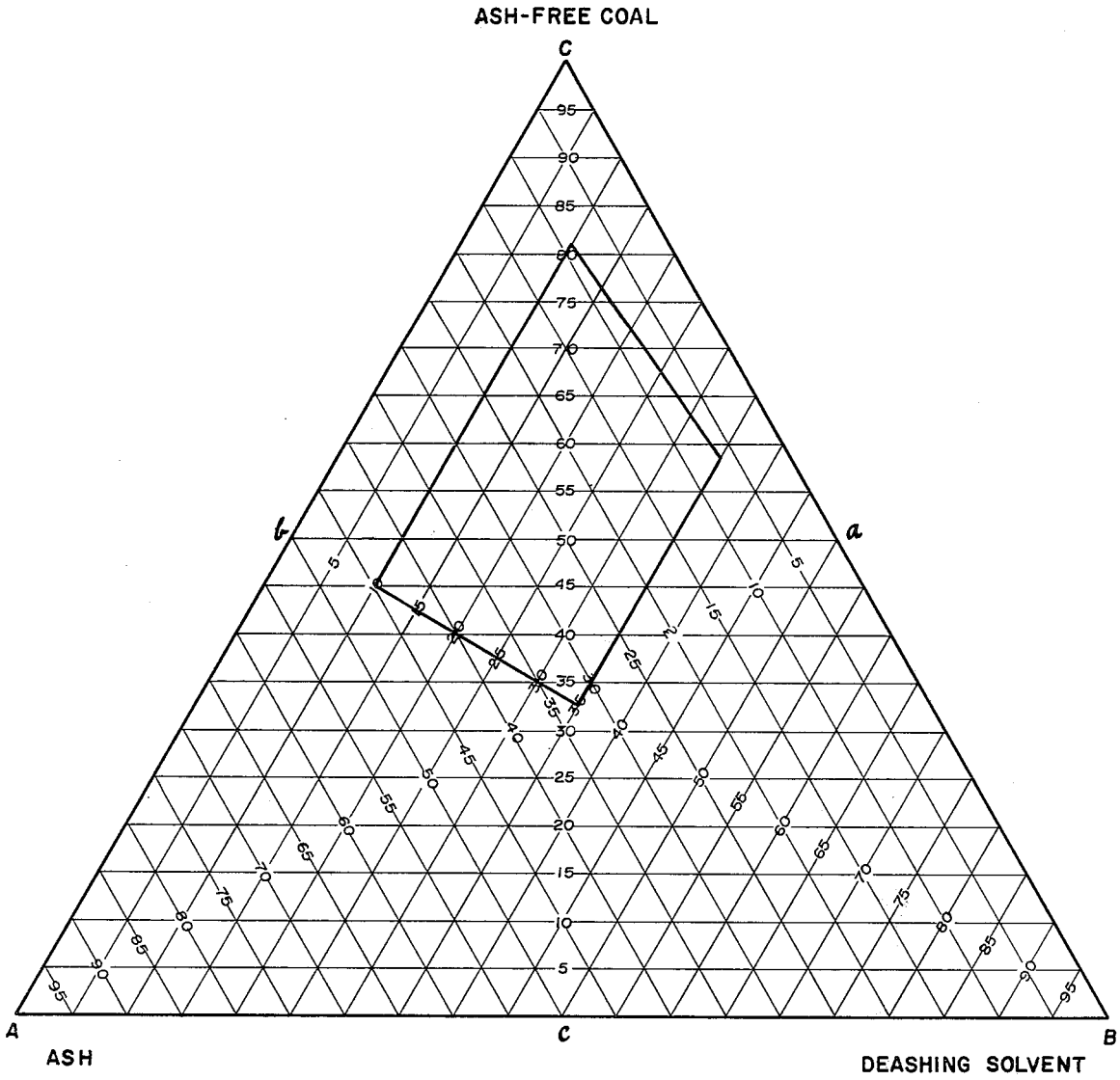
FIG. 2 is a triangular composition diagram showing the composition of the first heavy fraction in the first separation zone in terms of three components; deashing solvent, ash, and ash-free coal.

The composition characterized within TABLE I is also set forth in FIG. 2 wherein a triangular composition diagram is illustrated. The composition of the first heavy fraction in the first separation zone 14 is defined as the region within the trapezoid shown in the triangular composition diagram of FIG. 2. This composition has desirable fluid properties at temperature levels in a range from about 460 degrees F. to about 650 degrees F., depending upon the composition of the prepared mixture, choice of deashing solvent and the like. The relatively high viscosity of this flowable first heavy fraction also permits the discharge of the first heavy fraction from a relatively high pressure zone, having a pressure level in a range from about 700 psig to about 1000 psig, to a relatively low pressure zone, having a pressure level in a range from about 0 psig to about 50 psig. Thus, this unique composition comprising the first heavy fraction is flowable through an ordinary, commercially available valve and the pressure level of such composition (the first heavy fraction) can be reduced by up to about 1000 psig in a single step or stage (across a single valve) with minimal erosive wear of the valve seat or the valve stem, in lieu of utilizing a plurality of valves in series to effect the necessary pressure reduction, with a relatively small pressure drop being effected across each individual valve. In contrast with the first heavy fraction produced in accordance with the present invention, other materials having a relatively high solids content (such as slurries of coal liquefaction products from a coal hydrogenation process) will cause serious erosion of valve parts when expanded through a single pressure reducing valve in a manner just described in connection with the present invention.

The chemical analysis of the first heavy fraction in the first separation zone 14 indicates that there is a substantial variation in the chemical composition obtained from different feed coals and yet, it has been found that the first heavy fractions so produced in accordance with the present invention have essentially the same physical properties (flowable, viscous fluid), notwithstanding the different chemical compositions. A summary of the chemical composition of the first heavy fraction (solvent free basis) produced in the first separation zone 14 and in the conduit 22 connecting the first separation zone 14 with the flash zone 24 for five different feed mixtures derived from different feed coals is summarized in TABLE II, below (the oxygen content being determined by disregarding the oxygen chemically associated with the mineral matter or ash):

TABLE II

| Ultimate Analysis of Coal Product Composition | | | | | |
|---|---|---|---|---|---|
| Chemical Constituents | Sample[1] No. 1 Wt. % | Sample[2] No. 2 Wt. % | Sample[3] No. 3 Wt. % | Sample[4] No. 4 Wt. % | Sample[5] No. 5 Wt. % |
| Carbon | 57.4 | 50.2 | 46.9 | 59.4 | 63.6 |
| Hydrogen | 3.0 | 3.0 | 2.7 | 3.3 | 3.3 |
| Nitrogen | 1.0 | 1.0 | 1.2 | 1.0 | 1.3 |
| Sulfur | 0.8 | 4.05 | 6.9 | 3.6 | 2.5 |
| Oxygen (By Difference) | 3.3 | 1.75 | — | — | 2.6 |
| Ash | 34.5 | 40.4 | 43.6 | 32.7 | 26.7 |

[1]Wyodak feed coal to coal deashing process
[2]Illinois #6 feed coal to coal deashing process
[3]Kentucky #9 and #14 feed coal to coal deashing process
[4]Kentucky #9 and #14 feed coal to coal deashing process
[5]Pittsburgh #8 feed coal to coal deashing process Further, the "coal product composition" withdrawn from the flash zone 24 via the conduit 36 is essentially free of the deashing solvent. The coal product normally has the following composition: coal mineral matter in a range from about 20 percent to about 50 percent as indicated by ashing; and the remaining portion of such composition is predominantly carbon with relatively minor amounts of hydrogen, nitrogen, sulfur and oxygen. The hydrogen to carbon atomic ratio of such composition is in a range from about 0.60 to about 0.80, with the ratio typically being about 0.66, for example. The carbon content of such composition is generally in a range from about 45 percent by weight to about 70 percent by weight.

The composition withdrawn from the flash zone 24 via the conduit 36 (sometimes referred to herein as the "flashed first heavy fraction") is a light, powdery, black solid material and typical physical properties of this material are summarized in TABLE III, below:

TABLE III

| Physical Properties Of Coal Product Composition | | |
|---|---|---|
| Bulk Density - | 31 lb/ft$^3$ | |
| Particle Density - | 97 lb/ft$^3$ | |
| Angle of Repose - | 40–45° | |
| Size Distribution | | |
| Tyler Screen Mesh Size | Weight % | Weight % Ash |
| +28 | 9.0 | 37.1 |
| −28 +48 | 13.6 | 37.4 |
| −48 +65 | 8.2 | 37.7 |
| −65 +100 | 8.4 | 38.1 |
| −100 +150 | 8.5 | 37.6 |
| −150 +200 | 9.6 | 37.3 |
| −200 +270 | 7.3 | 37.7 |
| −270 +400 | 8.1 | 37.7 |
| −400 | 27.3 | 38.0 |

With respect to the Angle of Repose listed in TABLE III, above, it should be noted that the material withdrawn from the flash zone 24 may be readily fluidized. Further, with respect to the Size Distribution listed in TABLE III, above, it should be noted that the ash concentration in the flashed heavy fraction withdrawn through the conduit 36 was uniform throughout the various size fractions.

A more complete understanding of the chemical nature of the coal product composition of the present invention can be had by reference to a method of chemical fractionation utilizing highly selective solvents as described by D. D. Whitehurst et al in "The Nature And Origin of Asphaltenes In Processed Coals", the annual report of RP 410-1 produced under sponsorship of Electric Power Research Institute, and published February, 1976 (Government doc. no. PB 257569), the disclosure of which is incorporated herein by reference.

Chemical fractionation using Sequential Elution with Specific Solvents Chromatography (hereinafter referred to as SESC) provides a novel means for the separation of the coal product composition into discrete chemical classes which then can be used to characterize the composition.

In a variation of the above identified SESC procedure, a sample of coal derived material is eluted successively with the following solvents to form nine distinct fractions:

1. Hexanes (mixed isomers)
2. Hexanes/15% toluene
3. Chloroform
4. Chloroform/10% Diethyl Ether
5. Diethyl Ether/3% Ethanol
6. Methanol
7. Chloroform/3% Ethanol
8. Tetrahydrofuran/3% Ethanol
9. Pyridine/3% Ethanol and a tenth fraction comprising the residual insoluble coal products not eluted by the selective solvents. The ash-free coal content of the tenth fraction then is calculated by difference using the ash analysis of the original SESC sample. A SESC Analysis on an ash-free basis then is prepared. The results of several SESC Analyses of various coal derived materials are set forth in TABLE IV, below:

TABLE IV

| Sample No. | SESC Analysis On Ash-free Basis Fractions, Wt. % | | | | | | | | | |
|---|---|---|---|---|---|---|---|---|---|---|
| | 1 | 2 | 3 | 4 | 5 | 6 | 7 | 8 | 9 | 10 |
| 1[1] | 0.23 | 4.74 | 0.68 | 0.90 | 0.90 | 2.14 | 1.69 | 0.90 | 6.31 | 81.51 |
| 2[2] | 0.47 | 5.10 | 20.60 | 19.1 | 14.6 | 6.4 | 9.9 | 11.0 | 7.1 | 5.7 |
| 3[3] | 0.22 | 4.11 | 17.86 | 15.04 | 12.23 | 5.63 | 12.55 | 10.06 | 11.69 | 10.61 |
| 4[4] | 0.14 | 0.54 | 2.30 | 2.03 | 2.17 | 2.17 | 4.19 | 6.22 | 18.94 | 61.30 |
| 5 | 0.00 | 0.14 | 0.28 | 1.00 | 1.00 | 15.93 | 1.28 | 6.97 | 22.05 | 51.35 |
| 6[5] | 0.35 | 0.17 | 0.69 | 1.03 | 1.38 | 1.38 | 2.76 | 12.59 | 15.00 | 64.66 |
| 7 | 0.18 | 2.15 | 3.58 | 3.94 | 4.84 | 2.87 | 1.97 | 6.63 | 16.13 | 57.71 |
| 8 | 0.35 | 0.00 | 1.06 | 1.76 | 1.41 | 1.23 | 3.70 | 24.82 | 21.13 | 44.54 |
| 9 | 0.00 | 0.69 | 5.03 | 4.51 | 5.03 | 3.64 | 6.76 | 7.63 | 19.76 | 46.97 |
| 10 | 0.00 | 0.47 | 2.04 | 2.51 | 2.35 | 2.82 | 5.17 | 10.82 | 25.71 | 48.12 |
| 11 | 0.00 | 0.00 | 0.72 | 1.45 | 2.17 | 1.45 | 11.16 | 12.57 | 19.71 | 50.58 |

[1]Kentucky #9 and #14 raw coal
[2]Kentucky #9 and #14 ash-containing solvent refined coal
[3]Pittsburgh #8 ash-containing solvent refined coal
[4]Samples 4 and 5, coal product composition of the present invention derived from Pittsburgh #8 feed coal
[5]Samples 6–11, coal product composition of the present invention derived from Kentucky #9 and #14 feed coal Thus, as can readily be seen in TABLE IV, the various fractions produced as a result of the selective elution provide a means by which the coal product composition can be characterized through reference to the discrete chemical classes contained therein such that it can be easily distinguished from other coal derived materials.

The characterization is best achieved by reference to the SESC fractions 8, 9, and 10. It has been found that SESC fraction 10, on an ash-free basis, amounts to from about 40 percent to about 65 percent by weight of the coal product composition. Further, SESC fraction 9 amounts to from about 15 percent to about 30 percent by weight of the coal product composition and SESC fraction 8 amounts to from about 5 percent to about 25 percent by weight of the coal product composition. The balance of the coal product composition is the SESC fractions 1–7, on an ash-free basis.

Clearly, the ranges of these fractions differs greatly from the same fractions for other coal derived materials. Therefore, since these fractions represent the presence of certain discrete chemical classes possessing different chemical functionalities, the coal product composition is distinctly different from other coal derived materials.

The operating conditions (temperature level, pressure level and ratio of deashing solvent to feed) in the first separation zone 14 are influential in producing the powdery flashed first heavy fraction. The powdery composition is produced when the first separation zone is operated at certain temperature levels, certain pressure levels and ratios of deashing solvent to feed, while at certain other temperature levels, pressure levels and ratios of deashing solvent to feed, the composition (the powdery, flashed first heavy fraction) is not produced. Various conditions are itemized in TABLE V which have been found satisfactory to produce the composition (the powdery, flashed first heavy fraction) of the present invention.

In particular, it has been found that when the deashing solvent is toluene the temperature level in the first separation zone 14 should be maintained below about 640 degrees F. and preferably the temperature level in the first separation zone 14 is maintained in a range of from about 450 degrees F. to about 555 degrees F.

Further, when the deashing solvent is benzene, the temperature level in the first separation zone 14 should be maintained below about 620 degrees F. and preferably the temperature level in the first separation zone 14 is maintained in the range of from about 500 degrees F. to about 530 degrees F.

Still further, when the deashing solvent is a mixture of xylenes, the temperature level in the first separation zone 14 should be maintained in a range of from about 450 degrees F. to below about 650 degrees F.

Also, when the deashing solvent is a mixture comprising at least two members selected from the group consisting of toluene, benzene, xylene (ortho, meta, para or mixtures thereof), and the like, the temperature level in the first separation zone 14 should be maintained in a range of from about 450 degrees F. to about 650 degrees F.

TABLE V

| Deashing Solvent Introduced into mixing Zone 12 Via Conduit 28 | Ratio of Deashing Solvent to Prepared Mixture in the Mixing Zone 12 | Temperature Level (°F.) in the First Separation Zone 14 | Pressure Level (psig) in the First Separation Zone 14 |
|---|---|---|---|
| Toluene | 3.8[1] | 617 | 800 |
| Toluene | 1.7[2] | 520 | 800 |
| Benzene | 6.0[2] | 500 | 960 |
| Benzene | 5.0[2] | 500 | 950 |
| Xylenes[3] | 2.0[2] | 565 | 800 |
| Mixed Solvent[4] | 3.0[2] | 565 | 800 |

[1]Prepared mixture comprises ash-containing catalytically hydrogenated coal.
[2]Prepared mixture comprises ash-containing solvent refined coal.
[3]75.5% meta and para xylenes, 18% ortho xylene, 1.7% ethylbenzene and 4.8% other higher boiling components (percentages being by weight).
[4]20.1% toluene, 54.0% xylenes (mixture of ortho, meta and para) and 25.9% ethylbenzene (percentages being by weight).

It should be noted that each of the conditions listed in TABLE V were determined utilizing different coal feed materials and such differences in operating conditions utilizing the same deashing solvent may be attributed, in part, to the difference in coal liquefaction feed materials in the prepared mixture.

Various conditions are itemized in TABLE VI which are believed to produce a non-powdered, flashed first heavy fraction withdrawn from the flash zone 24 via the conduit 36:

TABLE VI

| Deashing Solvent Introduced into Mixing Zone 12 Via Conduit 28 | Ratio of Deashing Solvent to Prepared Mixture in the Mixing Zone 12 | Temperature Level (°F.) in the First Separation Zone 14 | Pressure Level (psig) in the First Separation Zone 14 |
|---|---|---|---|
| Toluene | 3.1[1] | 674 | 800 |
| Toluene | 2.1[2] | 630 | 800 |
| Toluene | 1.7[2] | 555 | 800 |
| Benzene | 6.0[2] | 620 | 960 |

TABLE VI-continued

| Deashing Solvent Introduced into Mixing Zone 12 Via Conduit 28 | Ratio of Deashing Solvent to Prepared Mixture in the Mixing Zone 12 | Temperature Level (°F.) in the First Separation Zone 14 | Pressure Level (psig) in the First Separation Zone 14 |
|---|---|---|---|
| Benzene | 5.0[2] | 590 | 950 |

[1]Prepared mixture comprises ash-containing Catalytically hydrogenated coal.
[2]Prepared mixture comprises ash-containing solvent refined coal.

The carbon content of the coal product composition produced by flashing the first heavy fraction in accordance with the present invention is useful as a fuel for generation of hydrogen, carbon monoxide or other fuel gases by various gasification techniques well known in the art. The physical nature of the powdery composition produced in accordance with the present invention is such that it is well suited to solids handling by fluidizing methods, for handling in screw feeders or other solids handling equipment.

Figure 3:
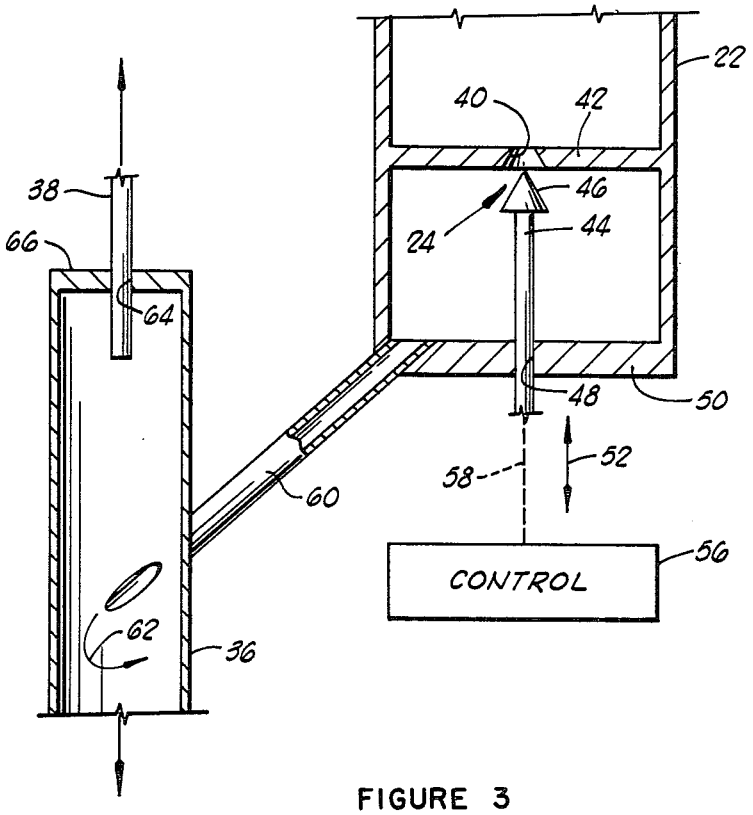
FIG. 3 is a diagrammatic view showing one particular embodiment of the flash zone shown in FIG. 1.

Referring more particularly to FIG. 3, shown therein is one particular embodiment of the flash zone 24. An opening (orifice) 40 is formed through a plate 42 which is disposed and secured within the conduit 22. A valve member 44, having a seating surface 46 formed on one end thereof, is disposed within the opening through the conduit 22. More particularly, the valve member 44 is slidingly disposed through an opening 48 formed through a packing (not shown) in plate 50 which is disposed and secured within the opening in the conduit 22, the plate 50 being spaced a distance from the plate 42.

The valve member 44 is positioned with respect to the orifice 40 and the seating surface 46 is shaped to seatingly engage the plate 42, in one position, closing the orifice 40. As the valve member 44 is moved away from the plate 42, flow is permitted through the orifice 40, the position of the valve member 44 seating surface 46 with respect to the orifice 40 controlling the rate of flow through the orifice 40. Thus, the valve member 44 is movable in directions 52 for controlling the rate of flow through the orifice 48. The valve member 44 is connected to a control 56 (such as a control valve, for example) via a mechanical connection designated via the general reference 58 in FIG. 3, for moving the valve member 44 in directions 52.

One end portion of a connecting tube 60 is inserted through the conduit 36, the other end being disposed in the space within the conduit 22, generally between the plates 42 and 50. The connecting tube 60 is connected to and oriented within the conduit 36 in such manner that fluid is discharged from the connecting tube 60 into the conduit 36 at an angle to cause the discharging fluid to enter the conduit 36 tangentially with respect to its wall, thereby creating a cyclone type of flow pattern as generally indicated via the direction arrow 62. As shown in FIG. 3, one end of a conduit 38 is disposed through one end of the conduit 36 and this end of the conduit 38 spaced a distance above the end of the connecting tube 60, which is disposed in the conduit 36.

During operations, the first heavy fraction is withdrawn from the first separation zone 14 and passed through the conduit 22 into the flash zone 24. In the flash zone 24, the first heavy fraction is passed through the restricted orifice 40 wherein the pressure level of the first heavy fraction is reduced by at least 100 psig. The first heavy fraction then passes through the connecting tube 60 and into the conduit 36. The flashed first heavy fraction enters the conduit 36 and the light vapor phase (essentially the deashing solvent) rises upwardly through the conduit 36. The light vapor phase is discharged through the conduit 38 and the insoluble coal products pass downwardly through conduit 36.

Various other specific embodiments of the flash zone 24 are possible and the specific embodiment shown in FIG. 3 has been provided only for the purpose of illustrating the present invention.

Changes may be made in the process apparatus or in the steps of the process or in the sequence of the steps of the process or in the compositions of the present invention without departing from the spirit and scope of the invention as defined in the following claims.

What is claimed is:

1. A process comprising:

providing a feed mixture comprising a deashing solvent, insoluble coal products and soluble coal products, said deashing solvent consisting essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

introducing the feed mixture into a first separation zone;

maintaining the temperature level in the first separation zone below about 700 degrees F. and the pressure level in the first separation zone in a range of from about the critical pressure of the deashing solvent to about 1000 psig to effect a separation of the feed mixture in the first separation zone into a first light fraction comprising the soluble coal products and most of the deashing solvent and a first heavy fraction comprising the insoluble coal products and some deashing solvent;

withdrawing the first heavy fraction from the first separation zone; and reducing the pressure level of the first heavy fraction by at least 100 psig to vaporize the deashing solvent from the first heavy fraction and yield a composition of matter comprising coal products in a powder-like form.

2. The process of claim 1 defined further to include:

maintaining the temperature level in the first separation zone in a range of from about 400 degrees F. to below about 700 degrees F.

3. The process of claim 1 defined further to include:

maintaining the temperature level in the first separation zone in a range of from about 400 degrees F. to about 650 degrees F.

4. The process of claim 1 defined further to include:

maintaining the temperature level and the pressure level in the first separation zone at predetermined levels for maintaining the first heavy fraction in a sufficiently fluid state to allow the first heavy fraction to flow from the first separation zone through an orifice while maintaining the first heavy fraction sufficiently viscous to allow the pressure level of the first heavy fraction to be reduced by a pressure differential of more than about 500 psig across the orifice with minimal erosion.

5. The process of claim 1 defined further to include:

maintaining the pressure level in the first separation zone in a range from about 700 psig to about 1000 psig.

6. The process of claim 1 defined further to include:

maintaining the pressure level in the first separation zone in a range from about 800 psig to about 950 psig.

7. The process of claim 1 wherein the step of providing the feed mixture is defined further to include the steps of:

providing a prepared mixture comprising soluble coal products and insoluble coal products;

providing the deashing solvent; and mixing in a mixing zone the prepared mixture with the deashing solvent to provide a mixture comprising the feed mixture.

8. The process of claim 1 defined further to include:

maintaining the ratio of the deashing solvent to the prepared mixture at a level higher than about 1.7.

9. The process of claim 1 wherein the deashing solvent is toluene and wherein the process is defined further to include:

maintaining the temperature level in the first separation zone below about 640 degrees F.

10. The process of claim 9 wherein the step of maintaining the temperature level in the first separation zone is defined further to include:

maintaining the temperature level in the first separation zone in a range from about 450 degrees F. to about 555 degrees F.

11. The process of claim 1 wherein the deashing solvent is benzene and wherein the process is defined further to include:

maintaining the temperature level in the first separation zone at a level below about 620 degrees F.

12. The process of claim 11 wherein the step of maintaining the temperature level in the first separation zone is defined further to include:

maintaining the temperature level in the first separation zone in the range of from about 500 degrees F. to about 530 degrees F.

13. The process of claim 1 wherein the step of reducing the pressure level of the first heavy fraction is defined further to include the steps of:

passing the first heavy fraction through an orifice for reducing the pressure level of the first heavy fraction to substantially atmospheric and producing one stream comprising the coal product composition and one other stream comprising the deashing solvent, the stream comprising the coal product composition being in a powder-like form; and separating the deashing solvent from the composition comprising coal products.

14. The process of claim 1 defined further to include the steps of:

withdrawing the first light fraction from the first separation zone;

introducing the first light fraction into a second separation zone at a temperature level in the range of from about 630 degrees F. to about 900 degrees F.

and a pressure level in the range of from about the critical pressure of the deashing solvent to about 1000 psig; and separating the first light fraction in the second separation zone into a second light fraction substantially comprising the deashing solvent and a second heavy fraction substantially comprising the soluble coal products.

15. The process of claim 14 defined further to include:

maintaining the pressure level in the second separation zone in the range of from about 650 psig to about 1000 psig.

16. The process of claim 1 wherein the deashing solvent is a mixture of xylenes and wherein the process is defined further to include:

maintaining the temperature level in the first separation zone below about 650 degrees F.

17. The process of claim 16 wherein the step of maintaining the temperature level in the first separation zone is defined further to include:

maintaining the temperature level in the first separation zone in a range from about 450 degrees F to below about 650 degrees F.

18. The process of claim 1 wherein the deashing solvent is a mixture of deashing solvents and wherein the process is defined further to include:

maintaining the temperature level in the first separation zone in a range from about 450 degrees F. to about 650 degrees F.

19. The process of claim 1 wherein the first heavy fraction is defined further as including from about 10 percent by weight to about 35 percent by weight of deashing solvent.

20. The process of claim 19 wherein the first heavy fraction is defined further as being flowable at a temperature level in a range from about 460 degrees F. to about 650 degrees F.

* * * * *